US010883783B2

(12) United States Patent
Johnson, Jr.

(10) Patent No.: US 10,883,783 B2
(45) Date of Patent: Jan. 5, 2021

(54) LOWER RECEIVER WITH LAST ROUND BOLT HOLD OPEN

(71) Applicant: Christopher W. Johnson, Jr., Longwood, FL (US)

(72) Inventor: Christopher W. Johnson, Jr., Longwood, FL (US)

( * ) Notice: Subject to any disclaimer, the term of this patent is extended or adjusted under 35 U.S.C. 154(b) by 0 days.

(21) Appl. No.: 16/381,658

(22) Filed: Apr. 11, 2019

(65) Prior Publication Data

US 2019/0316861 A1 Oct. 17, 2019

Related U.S. Application Data

(60) Provisional application No. 62/655,894, filed on Apr. 11, 2018.

(51) Int. Cl.

| | |
|---|---|
| ***F41A 17/36*** | (2006.01) |
| ***F41A 19/44*** | (2006.01) |
| ***F41A 3/66*** | (2006.01) |
| ***F41A 17/40*** | (2006.01) |
| ***F41A 17/42*** | (2006.01) |

(52) U.S. Cl.
CPC ..... *F41A 17/36* (2013.01); *F41A 3/66* (2013.01); *F41A 17/40* (2013.01); *F41A 17/42* (2013.01); *F41A 19/44* (2013.01)

(58) Field of Classification Search
CPC ..... F41A 17/36; F41A 17/40
See application file for complete search history.

(56) References Cited

U.S. PATENT DOCUMENTS 3,098,311 A * 7/1963 Savioli ..... F41A 17/36 42/18
2009/0249672 A1* 10/2009 Zedrosser ..... F41A 17/36 42/6
2017/0045324 A1* 2/2017 Zeman ..... C22C 1/1078

FOREIGN PATENT DOCUMENTS

EP 1058081 A2 * 12/2000 ..... F41A 17/36

* cited by examiner

*Primary Examiner* — Stephen Johnson
(74) *Attorney, Agent, or Firm* — Michael T. Abramson; Holland & Knight LLP

(57) ABSTRACT

An apparatus and method for creating the apparatus that holds a bolt open after a last round is fired from a magazine is disclosed. A lower receiver may include at least two cavities. A transfer bar may be configured to fit into a first cavity of the at least two cavities. A hold down may be configured to fit into a second cavity of the at least two cavities. At least a portion of the hold down may be configured to overlap with at least a portion of the transfer bar to hold the transfer bar in place. The transfer bar, when a final round is fired from a magazine in the lower receiver, may be pushed up by a bump in the magazine to transfer upward movement to the transfer bar that catches a bolt and holds the bolt open until activation of a release button.

19 Claims, 4 Drawing Sheets

TOP VIEW

TOP VIEW

SIDE VIEW

LOWER RECEIVER WITH LAST ROUND BOLT HOLD OPEN

RELATED CASES

This application claims the benefit of U.S. Provisional Application No. 62/655,894 filed on 11 Apr. 2018, the contents of which are all incorporated by reference.

BACKGROUND

The original AR15 "Mil-Spec" lower receiver was designed with an integrated last round bolt hold open feature, and was originally designed to function with the rifle round: .223/5.56×45 mm ammunition. The design of the last round bolt hold open may not function properly when modified.

BRIEF SUMMARY OF DISCLOSURE

In one example implementation, an apparatus that holds a bolt open after a last round is fired from a magazine may include but is not limited to a lower receiver. The lower receiver may include at least two cavities. A transfer bar may be configured to fit into a first cavity of the at least two cavities. A hold down may be configured to fit into a second cavity of the at least two cavities. At least a portion of the hold down may be configured to overlap with at least a portion of the transfer bar to hold the transfer bar in place. The transfer bar, when a final round is fired from a magazine in the lower receiver, may be pushed up by a bump in the magazine to transfer upward movement to the transfer bar that catches a bolt and holds the bolt open until activation of a release button.

One or more of the following example features may be included. The magazine may be a hand gun magazine. The transfer bar may be a wire. The transfer bar may be a rod. The transfer bar may be between 0.36 inches thick and 0.078 inches thick. At least the portion of the hold down may be bent over at least the portion of the transfer bar to overlap with at least the portion of the transfer bar. At least the portion of the hold down may be flat over at least the portion of the transfer bar to overlap with at least the portion of the transfer bar. The hold down may be one of locked and wedged into the second cavity. The lower receiver may be for one of an AR10 and an AR15.

In another example implementation, an apparatus that holds a bolt open after a last round is fired from a magazine may include but is not limited to a lower receiver. The lower receiver may include at least two cavities. A transfer bar may be configured to fit into a first cavity of the at least two cavities. The transfer bar, when a final round is fired from a magazine in the lower receiver, may be pushed up by a bump in the magazine to transfer upward movement to the transfer bar that catches a bolt and holds the bolt open until activation of a release button.

One or more of the following example features may be included. The magazine may be a hand gun magazine. The transfer bar may be a wire. The transfer bar may be a rod. The transfer bar may be between 0.36 inches thick and 0.078 inches thick. A hold down may be configured to fit into a second cavity of the at least two cavities. At least a portion of the hold down may be configured to overlap with at least a portion of the transfer bar to hold the transfer bar in place. At least the portion of the hold down may be bent over at least the portion of the transfer bar to overlap with at least the portion of the transfer bar. At least the portion of the hold down may be flat over at least the portion of the transfer bar to overlap with at least the portion of the transfer bar. The hold down may be one of locked and wedged into the second cavity. The lower receiver may be for an AR10. The lower receiver may be for an AR15.

In another example implementation, a method for creating an apparatus that holds a bolt open after a last round is fired from a magazine may include but is not limited to creating, in a lower receiver, a first cavity. A second cavity may be created in the lower receiver. A transfer bar may be fit into the first cavity. A hold down may be fit into the second cavity, wherein at least a portion of the hold down overlaps with at least a portion of the transfer bar to hold the transfer bar in place, and wherein the transfer bar, when a final round is fired from a magazine in the lower receiver, is pushed up by a bump in the magazine to transfer upward movement to the transfer bar that catches a bolt and holds the bolt open until activation of a release button.

One or more of the following example features may be included. The magazine may be a hand gun magazine. The transfer bar may be a wire. The transfer bar may be a rod. The transfer bar may be between 0.36 inches thick and 0.078 inches thick. A hold down may be configured to fit into a second cavity of the at least two cavities. At least a portion of the hold down may be configured to overlap with at least a portion of the transfer bar to hold the transfer bar in place. At least the portion of the hold down may be bent over at least the portion of the transfer bar to overlap with at least the portion of the transfer bar. At least the portion of the hold down may be flat over at least the portion of the transfer bar to overlap with at least the portion of the transfer bar. The hold down may be one of locked and wedged into the second cavity. The lower receiver may be for an AR10. The lower receiver may be for an AR15.

The details of one or more example implementations are set forth in the accompanying drawings and the description below. Other possible example features and/or possible example advantages will become apparent from the description, the drawings, and the claims. Some implementations may not have those possible example features and/or possible example advantages, and such possible example features and/or possible example advantages may not necessarily be required of some implementations.

BRIEF DESCRIPTION OF THE DRAWINGS

Like reference symbols in the various drawings indicate like elements.

DETAILED DESCRIPTION

Figure 1:
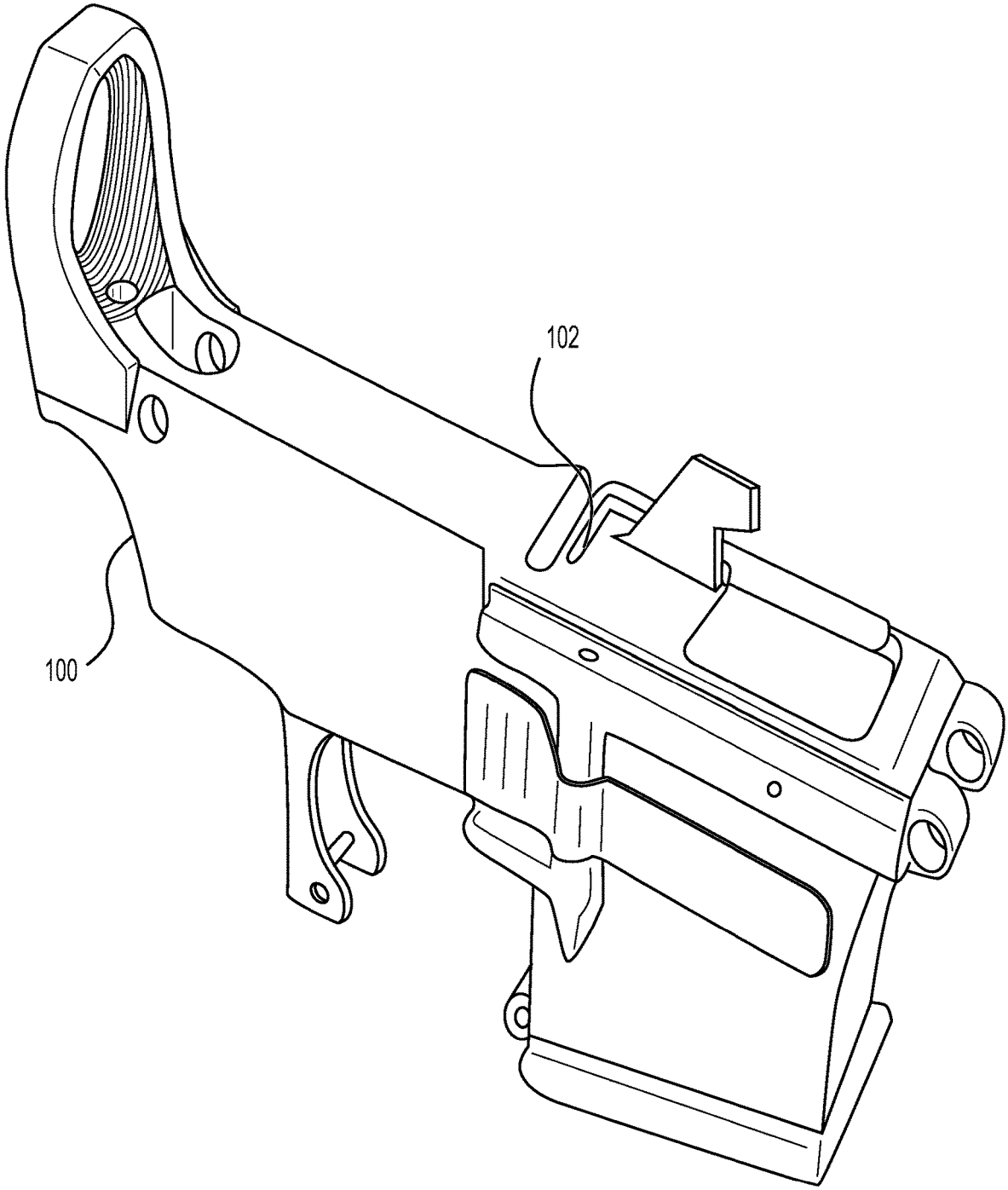
FIG. 1 is an example diagrammatic view of a lower receiver according to one or more example implementations of the disclosure.
Figure 2:
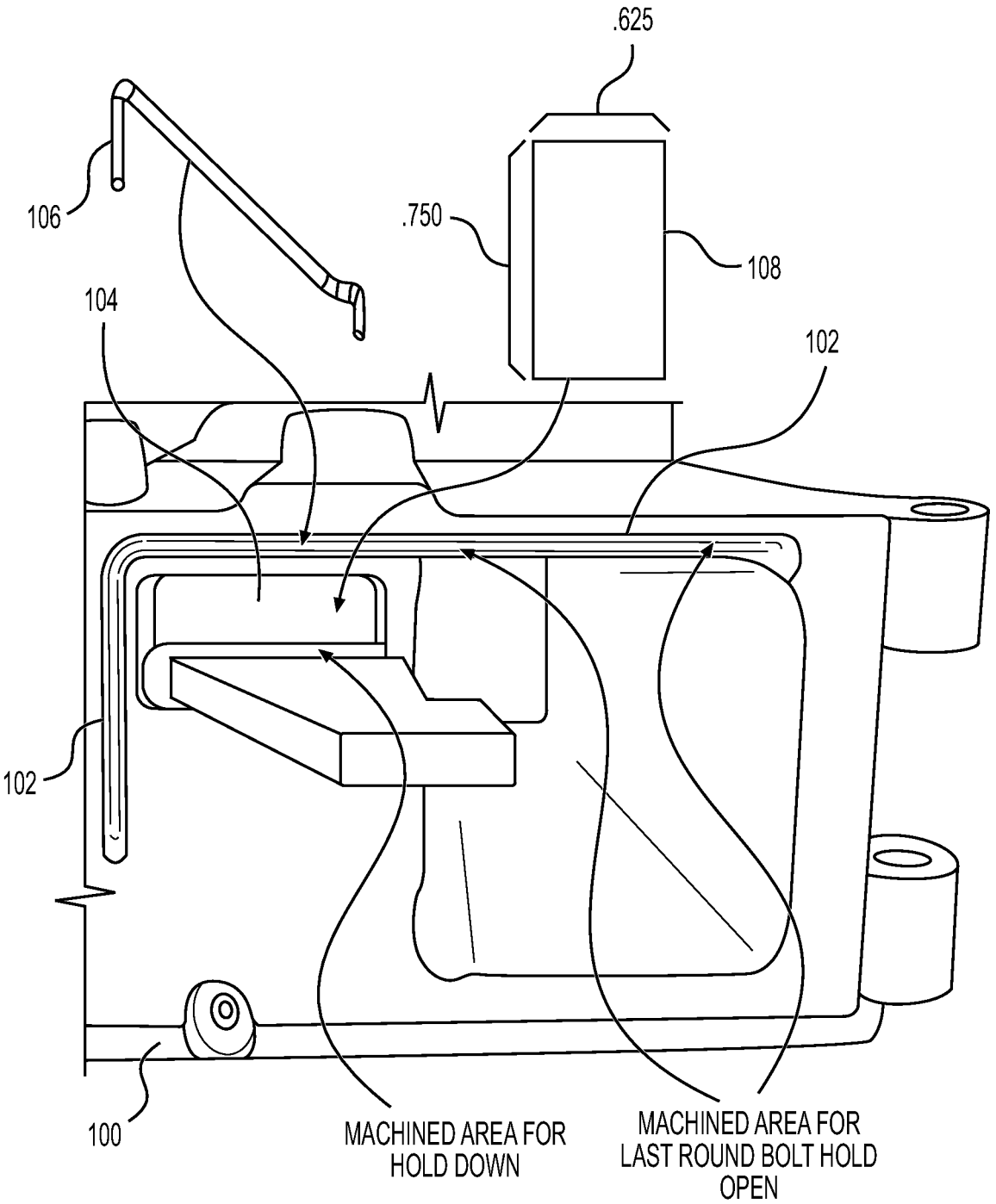
FIG. 2 is an example diagrammatic top view of the lower receiver of FIG. 1 and a transfer bar according to one or more example implementations of the disclosure.

The original AR15 "Mil-Spec" lower receiver was designed with an integrated last round bolt hold open feature, and was originally designed to function with the rifle round: .223/5.56×45 mm ammunition and a specific magazine type that accepts rigle rounds. Once the last round was fired from the rifle magazine, a bump designed into the back of the magazine pushes up on the bolt hold open catch (e.g., bolt hold open catch 400 shown in FIG. 4). The bolt hold open catch may stop the bolt from moving forward. After one ejects and reinstalls a reloaded magazine, pressing a bolt hold open (release) button releases the catch and the first round from the reloaded magazine is automatically loaded, and the firearm is ready to fire. The design of the last round bolt hold open may not function properly when modified. For example, the design of the last round bolt hold open in the original AR15 "Mil-Spec" lower receiver may not function properly when the lower receiver has been modified to function with a handgun cartridge and magazine (e.g., 9 mm×19 mm, .40 S&W, .357 SIG 10×25 mm, .45 ACP, Glock, Sig Sauer, Beretta, Smith & Wesson (S&W), Hekler & Koch (HK), etc.). By further modifying the lower receiver according to the examples of the present disclosure, the design of the last round bolt hold open in an AR15 lower receiver may function properly when the lower receiver has been modified to function with a handgun cartridge and magazine.

As will be discussed below, after the last round in a magazine is fired, the present disclosure may enable the bolt (i.e., what loads and ejects the round casing from the magazine and the firearm) to be held open, thereby eliminating the process of manually opening the bolt to load the first round from another magazine. For instance, in some implementations, and referring at least to the example implementations of FIGS. 1-4, an apparatus that holds a bolt open after a last round is fired from a magazine may include a lower receiver (e.g., lower receiver 100). For instance, an example of lower receiver 100 that may use the last round bolt hold open feature of the present disclosure is shown. In some implementations, the present disclosure may be used for lower receivers that have been either, e.g., machined from a raw block of material, from a generic forging, or from a mold kit. In some implementations, as will be discussed below, lower receiver 100 may differ from the "original" (i.e., "Military Specification AR15") design specifications of, e.g., the AR15 lower receiver.

In some implementations, lower receiver 100 may be for one of an AR10 and an AR15. For example, lower receiver 100 may be for an AR10 or an AR15 (including auto or semi-auto). However, it will be appreciated that the present disclosure may be modified such that lower receiver 100 may be used with any other another type of rifle or hand gun. As such, the description of an AR10 or AR15 should be taken as example only and not to otherwise limit the scope of the disclosure.

In some implementations, lower receiver 100 may include at least two cavities (e.g., first cavity 102 and second cavity 104). For instance, first cavity 102 is shown as an "L" shape on the top edge of receiver 100; however, it will be appreciated that other cavity shapes and locations capable of implementing the advantages of the present disclosure may also be used. For example, in some implementations, the first cavity shape may be thicker or flat, and may even include an embodiment that uses a more complicated transfer bar design. For instance, a smaller rod may be used that may transfer to another transfer bar the energy required to lift and hold the bolt open. In some implementations, first cavity 102 may be internal (as shown) or may bolt on externally to lower receiver 102.

In some implementations, a transfer bar (e.g., transfer bar 106) may be configured to fit into first cavity 102 of the at least two cavities. While the term "bar" is used to describe transfer bar 106, this should not be interpreted as any particular shape, material, or dimension. For instance, in some implementations, transfer bar 106 may be a wire, and in some implementations, transfer bar 106 may be a rod. In some implementations, transfer bar 106 may be between 0.36 inches thick and 0.078 inches thick, but other thicknesses may also be used. In some implementations, when transfer bar 106 is located in lower receiver 100, transfer bar 106 may be shaped to fit in-between the upper and lower and catch the front of the magazine (which is what provides the energy transfer to lift and hold the bolt open). In some implementations, transfer bar 106 may be round, oval, rectangular, square, or other shape. As such, the description of transfer bar being any particular shape, material (e.g., stainless steel), or dimension should be taken as example only and not to limit the scope of the disclosure.

In some implementations, lower receiver 100 may utilize transfer bar 106 by transfer bar 106 being bent and/or ground to certain specifications in a manner that allows it to pick up on the front edge of the magazine (i.e., if transfer bar 106 does not contact the front edge of the magazine, the energy may not transfer from the front of the magazine through transfer bar 106 to the back of the transfer bar (which is what provides the energy transfer to lift and hold the bolt open)). For instance, as noted above, transfer bar 106 may be any nominal gauged thickness (e.g., 0.36" thick wire, 0.078" thick wire, etc.) or material (e.g., stainless steel). Transfer bar 106 may fit into first cavity 102, which may be referred to as a slot or groove that may have been machined (or otherwise developed) into lower receiver 100. As will be discussed below, transfer wire 106 may be bent and ground in a way so the bolt is held open after the last round is fired from a magazine.

Figure 3:
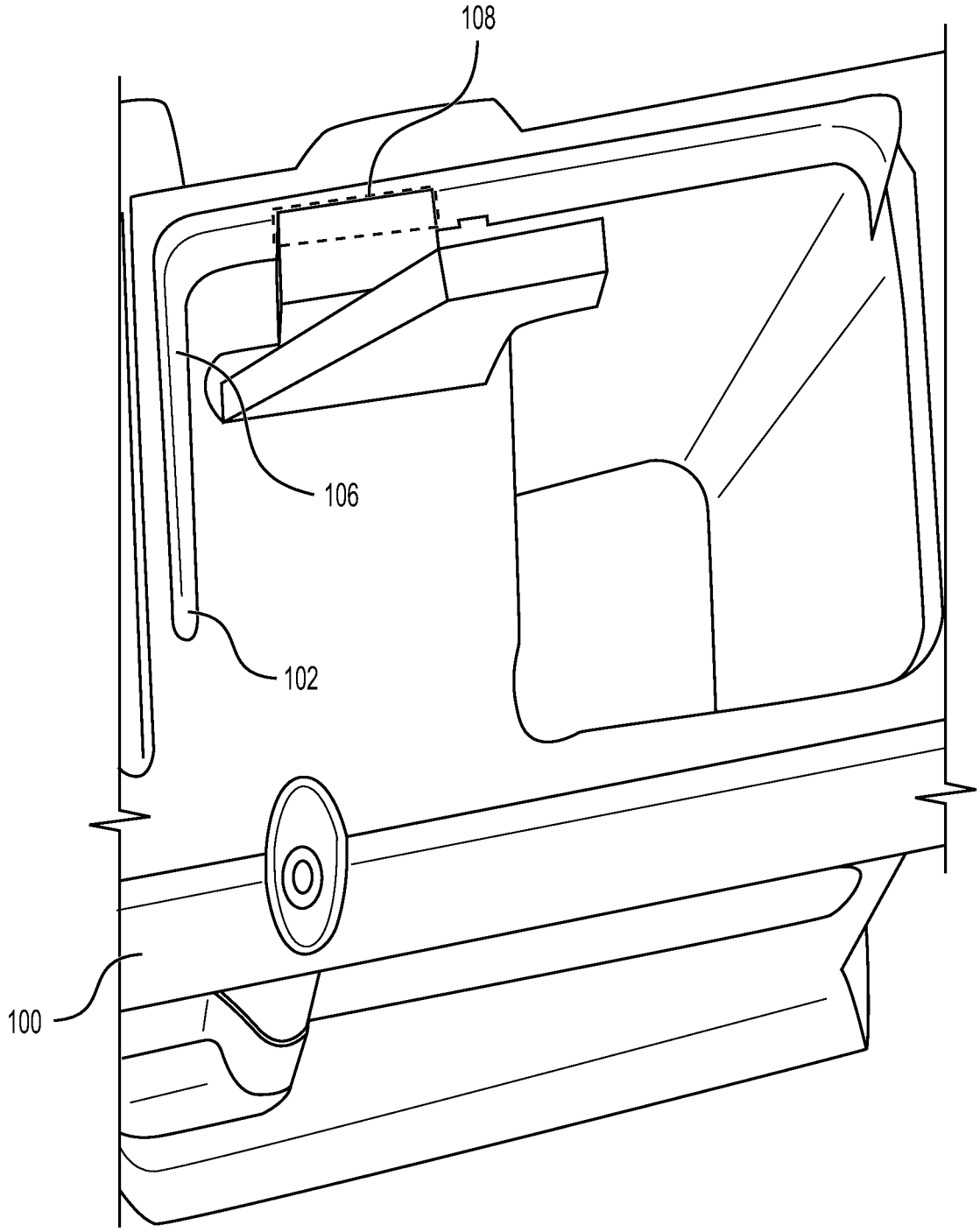
FIG. 3 is an example partial diagrammatic top view of the lower receiver of FIG. 1, transfer bar, and hold down according to one or more example implementations of the disclosure.

In some implementations, a hold down (e.g., hold down 108 also referred to as a retainer) may be configured to fit into second cavity 104 of the at least two cavities, and in some implementations, at least a portion of hold down 108 may be configured to overlap with at least a portion of transfer bar 106 to hold transfer bar 106 in place. For example, hold down 108 may fit into second cavity 104, which may be referred to as a slot or groove that may have been machined (or otherwise developed) into lower receiver 100, where the part of hold down 108 that is overlapped with the transfer bar portion is shown in FIG. 3 with dashed lines. Hold down 108 may retain transfer bar 106 in a consistent position (i.e., in first cavity 102) so that transfer bar 106 will not fall out during operation and/or before assembly. In some implementations, hold down 108 may be 20 gauge or may be of most any nominal gauged thickness or material (e.g., stainless steel). Generally, no plating or coating is required. In some implementations, hold down 108 may have the dimensions shown in FIG. 2; however, it will be appreciated that other dimensions (e.g., thickness, width, length, etc.), shapes, and locations of bold down 108 may be possible without departing from the scope of the disclosure.

In some implementations, to help retain transfer bar 106 in place, at least the portion of hold down 108 may be bent over at least the portion of transfer bar 106 to overlap with at least the portion of transfer bar 106, and in some implementations, at least the portion of hold down 108 may be flat over at least the portion of transfer bar 106 to overlap with at least the portion of transfer bar 106. Generally, whether hold down 108 is bent over transfer bar 106 or flat over transfer bar 106, transfer bar 106 should be loose enough to allow transfer bar 106 to rotate and transfer the movement from the front of the handgun magazine to the original bolt hold open (i.e., clearance between hold down 108 and transfer bar 106). If sufficient clearance is not achieved, hold down 108 may press too hard against transfer bar 106, preventing its movement during operation. In some implementations, the clearance may be around 0.005", but other clearance heights may be used depending on the dimensions of hold down 108, transfer bar 106, and depth of each of the cavities holding them respectively.

In some implementations, hold down 108 may be one of locked and wedged into second cavity 104. For instance, hold down 108 may be locked into place, e.g., via screws or any other method of attachment or hold down 108 may be wedged into place. In some implementations, hold down 108 may be held in place by the two screws that hold the ejector in place. In some implementations, hold down 108 may be wedged by some other manner or held in place by the lower/upper fitment. It will be appreciated that other techniques to secure hold down 108 in second cavity 104 may be used without departing from the scope of the disclosure.

In some implementations, transfer bar 106, when a final round is fired from a magazine (e.g., a hand gun magazine) in lower receiver 100, may be pushed up by a bump in the magazine to transfer upward movement to transfer bar 106 that catches a bolt and holds the bolt open until activation of a release button. For example, the handgun magazine is generally designed with a bump in the front of the magazine. When the last round is fired from the handgun magazine, transfer bar 106 may be pushed up by the bump in the handgun magazine and this may transfer the movement into the original bolt hold open (e.g., it moves it upwards) so it may catch the bolt (i.e., what loads and ejects the round casing from the magazine and the firearm) and hold it open until the bolt hold open release button is pressed.

Normally, when a bullet is in the magazine, transfer bar 106 is not touching the bump on the front of the magazine (the bump is generally located below the last bullet in the magazine). When the last bullet is loaded into the chamber, the bump pushes up against transfer bar 106. Transfer bar 106 may then apply pressure against the original bolt catch. Once the last round is fired, the upward pressure from the bump, applied through transfer bar 106 against the original bolt catch may catch and stop the bolt from cycling forward. The user may then eject the empty magazine, insert a new magazine with ammunition, whereby the pressure against transfer bar 106 may be removed (because the bump is now covered by ammunition), the bolt catch release button may be pressed and a round of ammunition may be pushed from the magazine into the chamber and the firearm is ready to be used (without having to manually load the firearm). The ability to load the firearm without having to manually perform the loading procedure allows the user to quickly change an empty magazine (i.e., the last round is fired, transfer bar 106 operates and holds the bolt back, the user pushes the magazine button and the magazine drops free, the user inserts another magazine and pushes the bolt release button, the firearm is loaded and the user is back to being able to fire it without having to take the time normally required to manually pull the bolt back.

Figure 4:
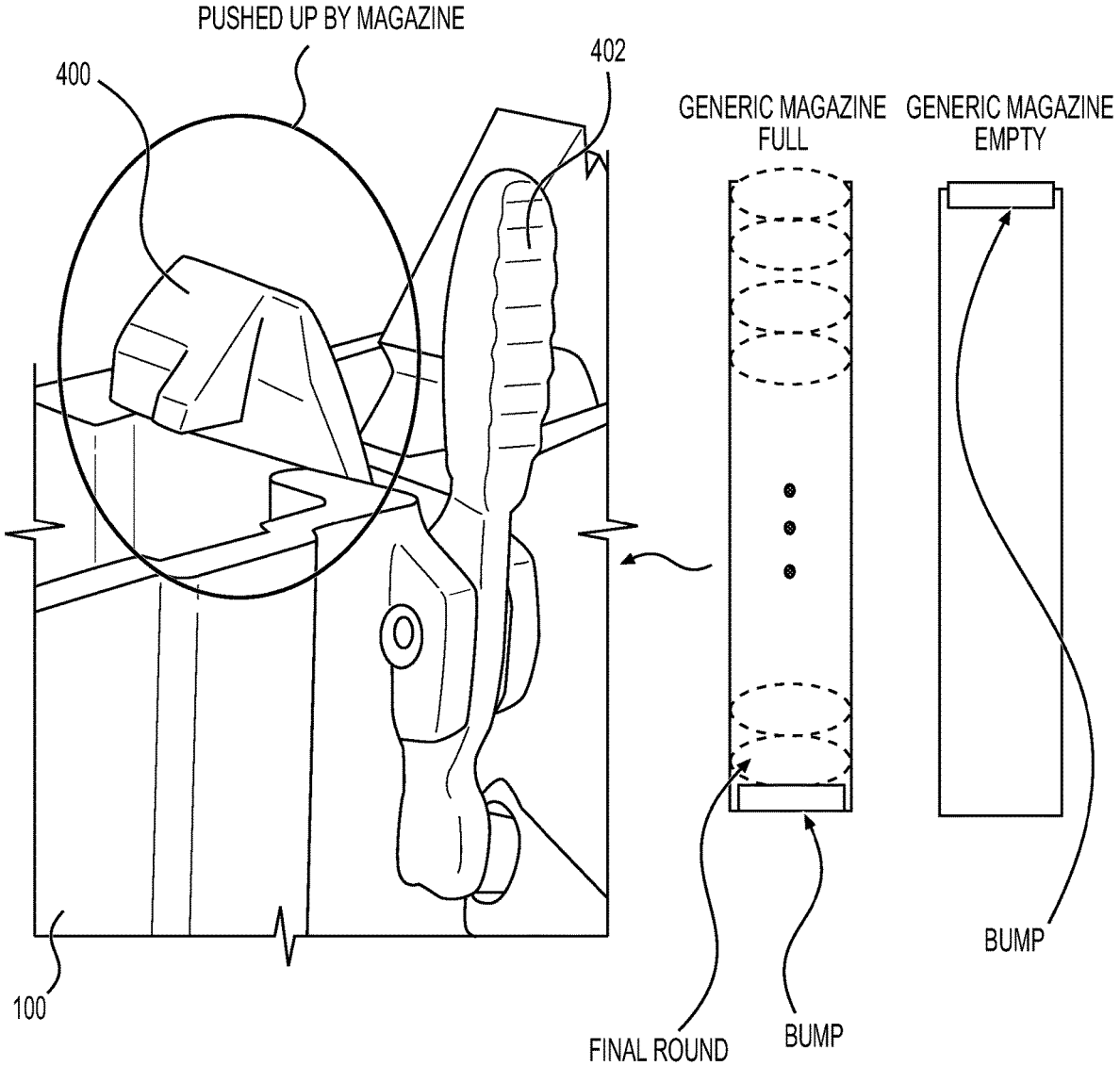
FIG. 4 is an example diagrammatic side view of the lower receiver of FIG. 1 with a last round bolt pushed up according to one or more example implementations of the disclosure.

An example of the bolt being caught and held open is shown at FIG. 4, where the bolt hold open catch 400 gets pushed up by either the factory magazine, or, in the case of the present disclosure, is pushed up by transfer bar 106. Therefore, the empty magazine may be removed and a reloaded magazine may be quickly installed in its place. After replacing the magazine, one may press bolt hold open (release) button 402, which may automatically load the first round from the reloaded magazine into the chamber without having to manually pull back the bolt and release it forward (which is currently required to load the first round of a handgun magazine). Accordingly, the present disclosure may permit the function of a last round bolt hold open feature when utilizing different types of handgun magazines and their corresponding ammunition in an AR15 (or other firearm) lower receiver.

In some implementations, the different types of magazines that may be used with the present disclosure may include but are not limited to Glock, Sig Sauer, Beretta, Smith & Wesson (S&W), Hekler & Koch (hK), and other generic replacement magazines, etc. Each of these magazines may have unique shapes. In some implementations, typical calibers that may be used with the present disclosure may include but are not limited to 9 mm×19 mm or .40 S&W or .357 SIG or 10×25 mm or .45 ACP, etc.

The terminology used herein is for the purpose of describing particular implementations only and is not intended to be limiting of the disclosure. As used herein, the singular forms "a", "an" and "the" are intended to include the plural forms as well, unless the context clearly indicates otherwise. As used herein, the language "at least one of A, B, and C" (and the like) should be interpreted as covering only A, only B, only C, or any combination of the three, unless the context clearly indicates otherwise. It will be further understood that the terms "comprises" and/or "comprising," when used in this specification, specify the presence of stated features, integers, steps (not necessarily in a particular order), operations, elements, and/or components, but do not preclude the presence or addition of one or more other features, integers, steps (not necessarily in a particular order), operations, elements, components, and/or groups thereof The corresponding structures, materials, acts, and equivalents (e.g., of all means or step plus function elements) that may be in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications, variations, substitutions, and any combinations thereof will be apparent to those of ordinary skill in the art without departing from the scope and spirit of the disclosure. The implementation(s) were chosen and described in order to explain the principles of the disclosure and the practical application, and to enable others of ordinary skill in the art to understand the disclosure for various implementation(s) with various modifications and/or any combinations of implementation(s) as are suited to the particular use contemplated.

Having thus described the disclosure of the present application in detail and by reference to implementation(s) thereof, it will be apparent that modifications, variations, and any combinations of implementation(s) (including any modifications, variations, substitutions, and combinations thereof) are possible without departing from the scope of the disclosure defined in the appended claims.

What is claimed is:

1. An apparatus that holds a bolt open after a final round is fired from a magazine comprising:

a lower receiver, wherein the lower receiver includes at least two cavities;

a transfer bar configured to fit into a first cavity of the at least two cavities located on top of the lower receiver;

a hold down configured to fit into a second cavity of the at least two cavities, wherein at least a portion of the hold down is configured to overlap with at least a portion of the transfer bar to hold the transfer bar in place; and wherein the transfer bar, when the final round is fired from the magazine in the lower receiver, is pushed up by a bump in the magazine to transfer upward movement to the transfer bar that catches the bolt and holds the bolt open until activation of a release button.

2. The apparatus of claim 1 wherein the magazine is a hand gun magazine.

3. The apparatus of claim 1 wherein the transfer bar is a wire.

4. The apparatus of claim 1 wherein the transfer bar is a rod.

5. The apparatus of claim 1 wherein the transfer bar is between 0.36 inches thick and 0.078 inches thick.

6. The apparatus of claim 1 wherein at least the portion of the hold down is bent over at least the portion of the transfer bar to overlap with at least the portion of the transfer bar.

7. The apparatus of claim 1 wherein at least the portion of the hold down is flat over at least the portion of the transfer bar to overlap with at least the portion of the transfer bar.

8. The apparatus of claim 1 wherein the hold down is one of locked and wedged into the second cavity.

9. The apparatus of claim 1 wherein the lower receiver is for one of an AR10 and an AR15.

10. An apparatus that holds a bolt open after a final round is fired from a magazine comprising:

a lower receiver, wherein the lower receiver includes at least one cavity;

a transfer bar configured to fit into a first cavity of the at least one cavity located on top of the lower receiver; and wherein the transfer bar, when the final round is fired from the magazine in the lower receiver, is pushed up by a bump in the magazine to transfer upward movement to the transfer bar that catches the bolt and holds the bolt open until activation of a release button.

11. The apparatus of claim 10 wherein the magazine is a hand gun magazine.

12. The apparatus of claim 10 wherein the transfer bar is a wire.

13. The apparatus of claim 10 wherein the transfer bar is a rod.

14. The apparatus of claim 10 wherein the transfer bar is between 0.36 inches thick and 0.078 inches thick.

15. The apparatus of claim 10 further comprising a hold down configured to fit into a second cavity of the at least one cavity, wherein at least a portion of the hold down is configured to overlap with at least a portion of the transfer bar to hold the transfer bar in place.

16. The apparatus of claim 15 wherein at least the portion of the hold down is bent over at least the portion of the transfer bar to overlap with at least the portion of the transfer bar.

17. The apparatus of claim 15 wherein at least the portion of the hold down is flat over at least the portion of the transfer bar to overlap with at least the portion of the transfer bar.

18. The apparatus of claim 15 wherein the hold down is one of locked and wedged into the second cavity.

19. The apparatus of claim 10 wherein the lower receiver is for one of an AR10 and an AR15.

* * * * *